US009150996B2

(12) United States Patent
Behbehani

(10) Patent No.: US 9,150,996 B2
(45) Date of Patent: Oct. 6, 2015

(54) BICYCLE-DRIVEN CLOTHES WASHING MACHINE

(71) Applicant: Fawzi Behbehani, Safat (KW)

(72) Inventor: Fawzi Behbehani, Safat (KW)

( * ) Notice: Subject to any disclaimer, the term of this patent is extended or adjusted under 35 U.S.C. 154(b) by 134 days.

(21) Appl. No.: 14/017,171

(22) Filed: Sep. 3, 2013

(65) Prior Publication Data

US 2015/0059414 A1 Mar. 5, 2015

(51) Int. Cl.
*D06F 37/30* (2006.01)
*D06F 21/04* (2006.01)

(52) U.S. Cl.
CPC ..... *D06F 37/30* (2013.01); *D06F 21/04* (2013.01)

(58) Field of Classification Search
None
See application file for complete search history.

(56) References Cited

U.S. PATENT DOCUMENTS

| | | | | |
|---|---|---|---|---|
| 4,052,912 | A | 10/1977 | Vukelic | |
| 2005/0126230 | A1* | 6/2005 | Choi | 68/23.2 |
| 2006/0254323 | A1* | 11/2006 | Kim | 68/235 R |
| 2007/0113597 | A1* | 5/2007 | Kim | 68/140 |
| 2011/0230286 | A1 | 9/2011 | Cohen | |

FOREIGN PATENT DOCUMENTS

| | | | | |
|---|---|---|---|---|
| CN | 201045170 | Y | | 4/2008 |
| CN | 201068525 | Y | | 6/2008 |
| CN | 201080558 | Y | | 7/2008 |
| CN | 101424021 | A | | 5/2009 |
| CN | 101748580 | A | | 6/2010 |
| CN | 102337654 | A | | 2/2012 |
| CN | 202193982 | U | | 4/2012 |
| CN | 202227146 | U | | 5/2012 |
| JP | 3142509 | U | | 6/2008 |
| KR | 10-2011-0003822 | | | 1/2011 |
| KR | 2011003822 | A | * | 1/2011 |

* cited by examiner

*Primary Examiner* — Michael Kornakov
*Assistant Examiner* — Cristi Tate-Sims
(74) *Attorney, Agent, or Firm* — Richard C Litman

(57) ABSTRACT

The bicycle-driven clothes washing machine includes a bicycle frame, a drive mechanism, and a washing machine drum assembly adjacent the bicycle frame. The drum assembly includes an outer drum having at least a portion thereof at least transparent or partially transparent, the outer drum selectively filled with a washing liquid. An inner drum having a plurality of perforations is rotatably positioned inside the outer drum and mounted to the drive mechanism to be driven thereby via pedal action, the inner drum holding contents to be washed. Both the outer drum and the inner drum can be provided with respective covers to secure contents within the respective drums. An inlet line for introducing washing liquid and an outlet line for draining are attached to the outer drum. Each inlet and outlet line is provided with a valve system selectively operable to supply washing liquid for washing and draining the washing liquid.

15 Claims, 6 Drawing Sheets

BICYCLE-DRIVEN CLOTHES WASHING MACHINE

BACKGROUND OF THE INVENTION

1. Field of the Invention

The present invention relates to pedal actuated devices, and particularly to a bicycle-driven clothes washing machine providing efficient use of exercise time for laundering and reduce energy consumption.

2. Description of the Related Art

Time is a valuable commodity. Many strive to make efficient use of time for both professional and personal matters. Unfortunately, there usually never seems to be enough time to accomplish as much as desired in any given day. Another task always seems to loom on the horizon.

Many devices have been developed that ease the workload and oftentimes reduce the amount of time required to accomplish the same. Take, for example, laundry in the realm of household chores. Prior to automated washing machines, one had to wash clothes and linen by hand which could often require hours of manual labor for even one typical load of laundry. The conventional, modern washing machines typically can perform clothes washing in relatively less time with relatively minimal physical expenditure involved, such as toting the load of laundry to be washed, adding a measured amount of detergent and setting the cycles on the washing machine, for example.

While convenient and timesaving, these conventional washing machines can consume relatively large amounts of energy and water, for example. Also, relatively recently, energy and environmental conservation typically are of concern, particularly in view of rising energy costs and an increased awareness of long-range environmental impact considerations. Further, in some areas of the world, conveniences, such as electrical energy or a ready supply of water, are not readily available or are of limited supply. While energy efficient washing machines have been developed, they tend to be relatively more expensive and can be therefore unaffordable, such as to those with limited financial means.

In addition to regular household chores, many individuals also try to allocate some time for periodic exercise. Physical exercise can help maintain good health and longevity, for example. However, exercise time can often be overlooked in view of seemingly more pressing needs or demands. When an individual's time is viewed in relation to time expended for household chores, such as laundering, it can be beneficial to more efficiently utilize an individuals' time while performing household tasks, such as laundering or washing clothes or other items, by including some form of exercise together with performing such household tasks.

Thus, a bicycle-driven clothes washing machine addressing the aforementioned problems is desired.

SUMMARY OF THE INVENTION

Embodiments of a bicycle-driven clothes washing machine include a bicycle frame, a drive mechanism associated with the bicycle frame, and a washing machine drum assembly disposed in association with the bicycle frame. The drum assembly includes an outer drum having at least a portion of the outer drum constructed from a transparent plastic material to monitor the washing activity or washing operation in the outer drum, the outer drum selectively filled with the washing liquid, such as including water. An inner drum constructed from a suitable material and having a plurality of perforations is rotatably mounted inside the outer drum to the drive mechanism and configured to be driven thereby, such as via pedal action, the inner drum holding contents or items to be washed, rinsed, or spin dried. Both the outer drum and the inner drum can be provided with respective covers to secure contents within the respective drums. An inlet line for introducing a washing liquid, such as water, and an outlet line for draining the washing liquid are attached to the outer drum. The inlet line is provided with an inlet valve system and the outlet line is provided with an outlet valve system selectively operable to respectively supply the washing liquid for washing or rinsing the contents or items and drain the used washing liquid.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
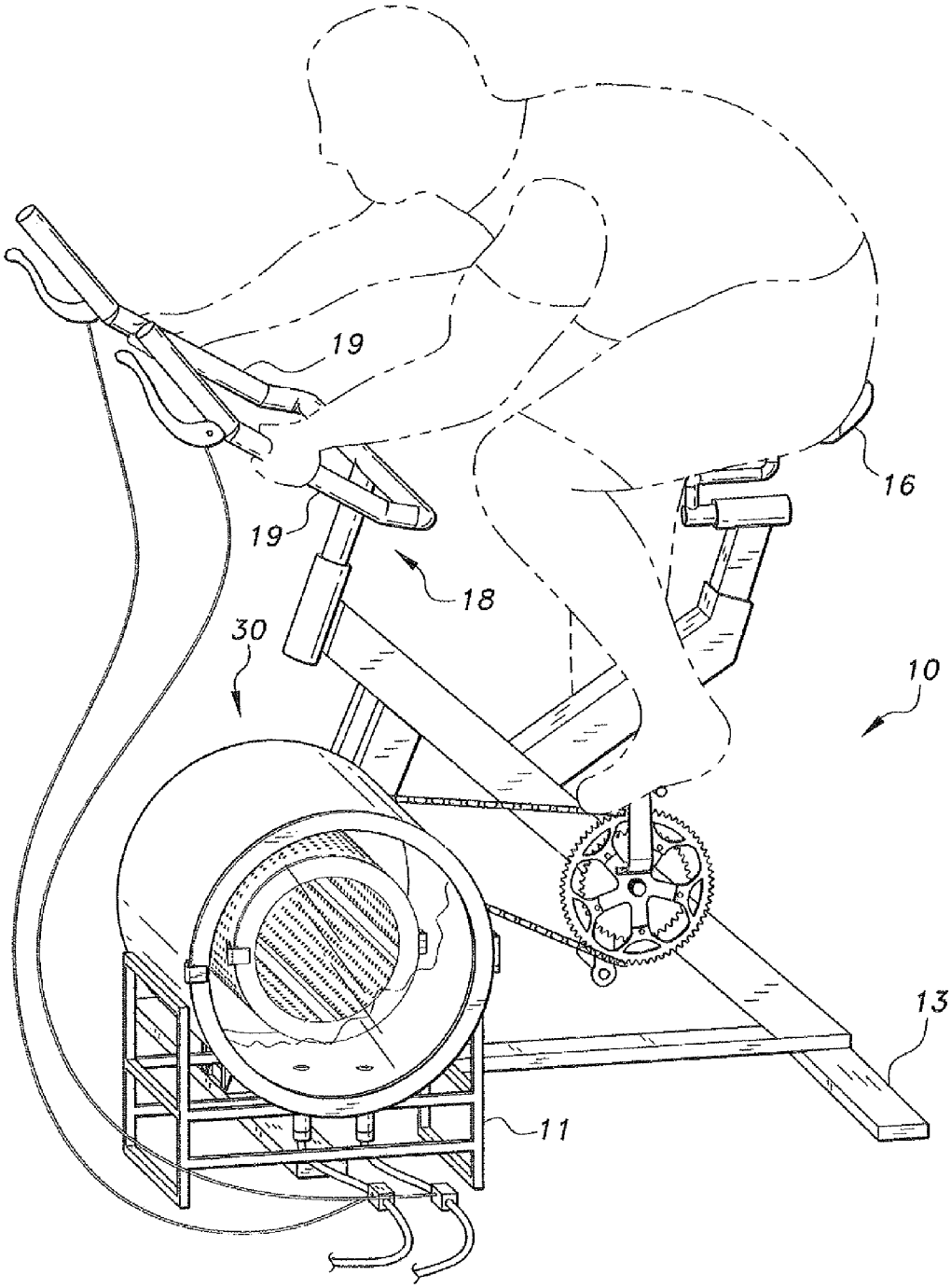
FIG. 1 is an environmental, perspective view of an embodiment of a bicycle-driven clothes washing machine according to the present invention.

Embodiments of a bicycle-driven clothes washing machine, an embodiment of which is generally referred to by the reference number 10, can provides a convenient means of efficiently maximizing a user's time and can reduce energy consumption by utilizing the physical effort from exercise to power a clothes washing device. As best seen in FIGS. 1-4, the bicycle-driven clothes washing machine 10 includes an exercise bike or bicycle 12 mounted to a bicycle support base 13 and a washing machine drum assembly 30 mounted or positioned adjacent, such as to a side of the exercise bike or bicycle 12, such as can be supported on a support member 11, the support member 11 being disposed in association with a bicycle frame 14 of the exercise bike or bicycle 12, for example. The washing machine drum assembly 30 can also be referred to as a drum assembly, for example. In an embodiment of the bicycle-driven clothes washing machine 10, the washing machine drum assembly 30 is disposed at the front of the exercise bike or bicycle 12, such as where a front tire of a conventional bicycle normally resides, for example.

The support member 11 supports the washing machine drum assembly 30 providing an elevated support for the washing machine drum assembly 30 during operation and can assist in relieving a potential bending torque that could break the washing machine drum assembly 30 away from the exercise bike or bicycle 12 if left freely hanging in the bicycle-driven clothes washing machine 10, for example. The support member 11 can be fixed onto the washing machine drum assembly 30 or constructed as a separate component where the latter can provide an increased portability and versatility in terms of ease of relocating the bicycle-driven clothes washing machine 10.

The exercise bike or bicycle 12 includes the bicycle frame 14, an adjustable seat 16, and an adjustable handlebar assembly 18, the adjustable components permitting user-defined positioning of the seat 16 and handlebars 19 of the adjustable handlebar assembly 18 for relatively comfortable physical activity. A drive mechanism 20 is associated with, such as being mounted to, the bicycle frame 14 and the drive mechanism 20 is communicatively connected to the washing machine drum assembly 30 so as to be driven thereby. The drive mechanism 20 includes a motive force generating device, such as including a pair of pedals 22, operably connected to or associated with a drive sprocket assembly 21. The drive sprocket assembly 21 includes a plurality of drive sprocket gears 23*a*, 23*b* with varying diameters and sprocket teeth in order to facilitate variable drive speeds for driving the washing machine drum assembly 30, such as an inner drum 40, to generate and provide a motive force to rotate the inner drum 40 through movement of the pedals 22 for a washing activity or washing operation, such as washing, rinsing or spin drying various contents, such as laundry or other items, for example.

Figure 3:
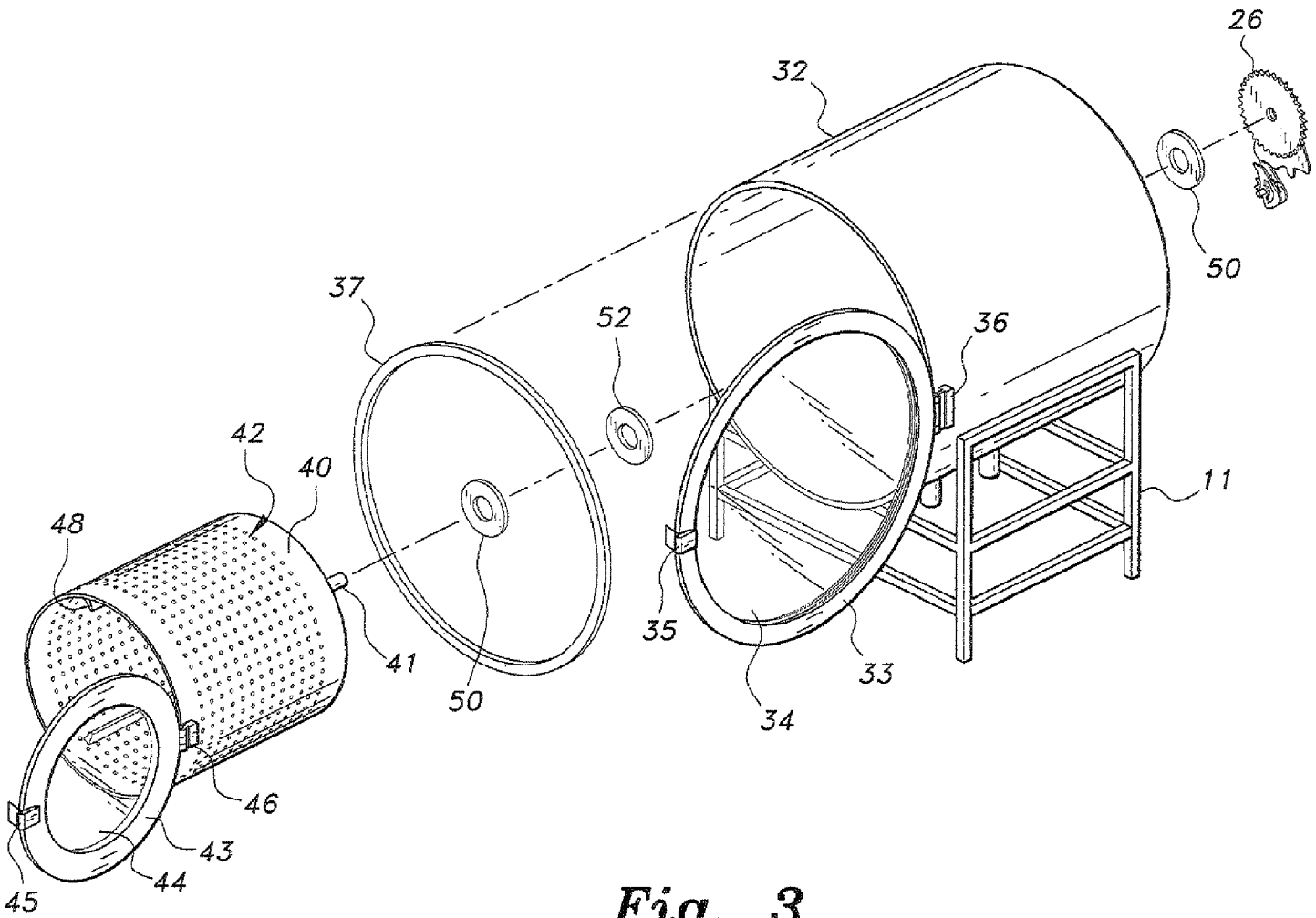
FIG. 3 is an exploded view of the bicycle-driven clothes washing machine shown in FIG. 1 without the bicycle frame for clarity.
Figure 5:
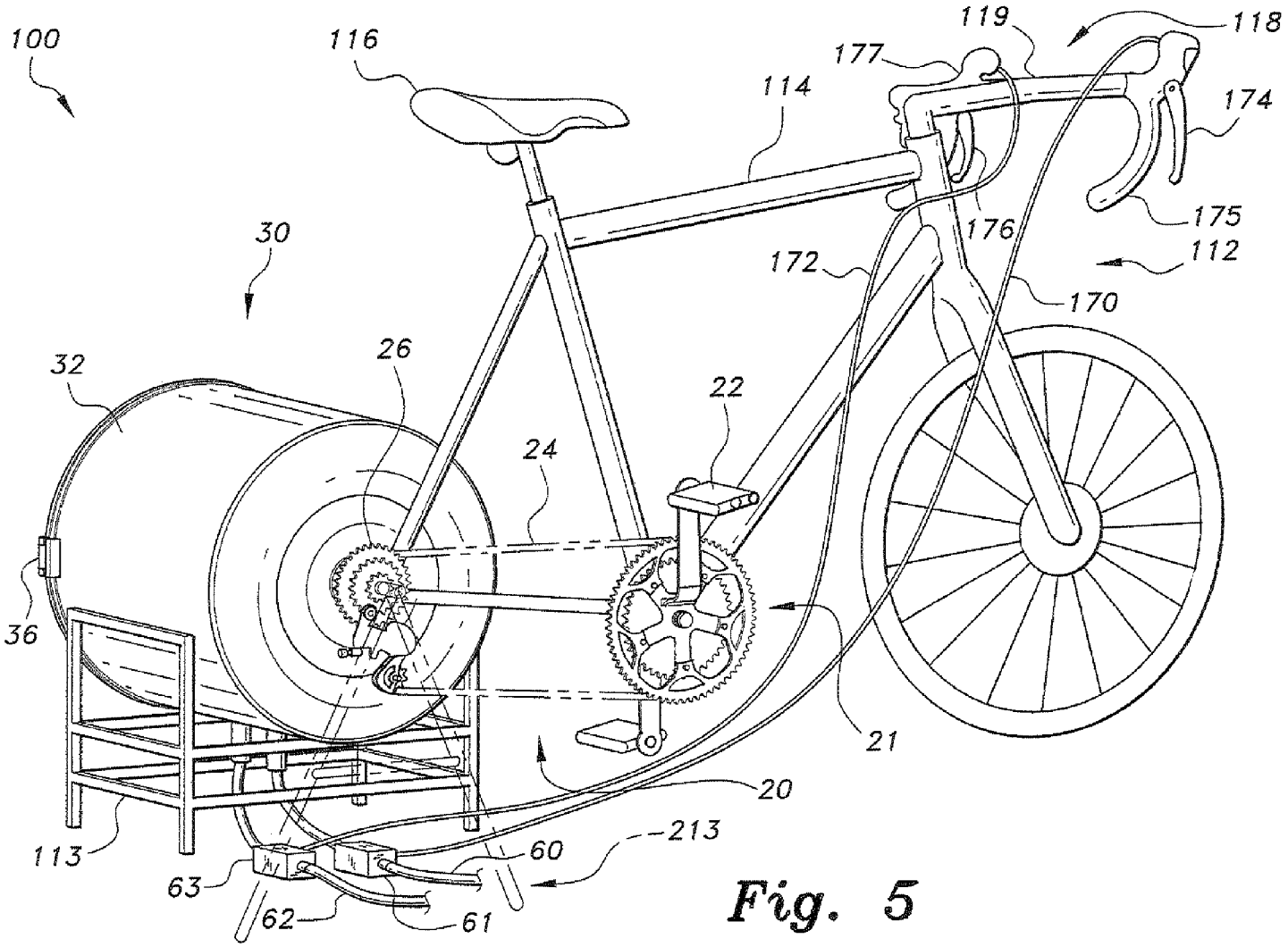
FIG. 5 is a perspective view of an embodiment of a bicycle-driven clothes washing machine according to the present invention.

An output mechanism, such as including a drive belt or drive chain 24 training around one of the drive sprockets 23*a*, 23*b* to a driven sprocket gear 26 of one or more driven sprocket gears 26, as illustrated in FIG. 5, is operatively connected to rotatable components in the washing machine drum assembly 30, the details of which will be further described below to selectively supply the motive force to rotate the inner drum 40, for example. Although only one driven sprocket gear 26 is shown in FIG. 3, it is to be understood that the exercise bike or bicycle 12 can be provided with additional driven sprocket gears 26, such as illustrated in FIG. 5, in an assembly to increase variable speed levels and control thereof, for example. With the above construction, the user provides motive force by pedaling the pedals 22 to rotate and to drive the drive sprocket assembly 21. The interconnection of the drive belt or drive chain 24 to the output or driven sprocket gear 26 rotates the driven sprocket gear 26 through movement of the drive belt or drive chain 24 to facilitate rotation of the rotating components of the washing machine drum assembly 30, such as to facilitate rotation of the inner drum 40 through movement of the driven sprocket gear 26, for example. Also, the drive belt or drive chain 24 can be replaced with a toothed drive belt, or other suitable endless driving or belt-type component, for example, that can transmit torque to the driven sprocket gear 26 when acted on by the drive sprocket assembly 21.

As best seen in FIG. 3, the washing machine drum assembly 30 includes an outer tank or outer drum 32 and a rotatable inner tank or inner drum 40 mounted inside the outer tank 32. The outer drum 32 holds the washing liquid, such as including water, needed to wash the contents, such as laundry or other items, to be washed and is desirably constructed, at least a part of or at least a portion thereof, from a transparent plastic material. The transparency of a substantial portion of or of a portion of the outer drum 32 can permit the user of the bicycle-driven clothes washing machine 10 to visually monitor a washing activity or washing operation within the washing machine drum assembly 30, such as occurring in the outer drum 32, during the washing operation. The outer drum 32 includes a cover 33 pivotally attached to the outer drum 32 by a hinge 36. When closed, the cover 33 is secured by a latching mechanism 35. The cover 33 generally serves to form a watertight or substantially watertight seal to assist in preventing the washing liquid, such as water, from spilling onto the floor or ground during use of the bicycle-driven clothes washing machine 10. The seal can be provided by an O-ring 37 attached to the cover 33 or on the lip of the outer drum 32, for example.

In an embodiment of the bicycle-driven clothes washing machine 10, the cover 33 desirably includes a transparent window 34 constructed from a suitable transparent material, such as transparent plastic, glass or like materials for visual monitoring, for example. Also, the window 34 can be opaque or partially opaque, since the transparency of substantially all or a portion of the outer drum 32 can permit relatively sufficient visibility of the washing operation of the contents or items in the washing machine drum assembly 30, such as from the user's riding position on the exercise bike or bicycle 12. Further, for example, the cover 33 can be a removable component selectively attached to outer drum 32 by various means, such as a plurality of latching mechanisms or threaded connections.

The outer drum 32 is also of a suitable shape, configuration or form, such as desirably of cylindrical or generally cylindrical shape, configuration or form, which is a relatively simple geometric shape to construct and manufacture, for example. However, other geometric forms, configurations or shapes such as square, rectangular or polygonal containers can also be used for the outer drum 32, so long as such forms, configurations or shapes can be suitably accommodated and can be housed the inner drum 40, for example.

The inner tank or the inner drum 40 is also of a suitable shape, configuration or form, such as desirably of a cylindrical or a generally cylindrical shape, configuration or form, to hold the contents, such as laundry or other items, to be washed, rinsed or spin dried, for example. The inner drum 40 includes a plurality of perforations or holes 42 that permit ingress and egress of the washing liquid, such as including water, inside the outer drum 32 during use to wash, rinse or spin dry the laundry, contents or items inside the inner drum 40. As with the outer drum 32, the inner drum 40 can be constructed in various shapes, configurations and forms, as long as such shape, configuration or form does not interfere with the rotation of the inner drum 40 within the outer drum 32, for example.

The inner drum 40 is desirably constructed from a suitable material, such as a lightweight durable metal material, such as an aluminum material and the like, that typically can withstand the rigors of regular washing cycles and can exhibit resistance to rust and corrosion, especially against some of the chemicals in common detergents used in cleaning or washing laundry and the like. Such a metal construction for the inner drum 40 can also be a metal material coated with a corrosion resistant layer for resistance to rust and corrosion, for example. Also, the inner drum 40 can be constructed of other suitable materials, such as from durable plastic, steel, such as a stainless steel, composites, wood, and combinations of materials thereof. Also, the inner drum 40 can be constructed of suitable materials so that all or a part of or a portion of the inner drum 40 can be transparent or non-transparent, for example. Some of these materials used for forming the inner drum 40 can require treatments or material compositions to account for the working environment, such as including the washing liquid detergents, in which the inner drum 40 is used, for example.

The inner drum 40 is also provided with a cover 43 pivotally attached to the inner drum 40 by a hinge 46. A latching mechanism 45 secures the cover 43 onto the opening of the inner drum 40. As with the outer drum cover 33, the inner drum cover 43 can be provided with a window 44, the window 44 desirably can be transparent, but all or part of the window 44 can also be opaque or non-transparent, for example. The cover 43 desirably forms a watertight or substantially watertight seal so as to limit washing liquid, such as including water, penetration to that passing through the perforations 42. Also, use of such watertight or substantially watertight seal can be considered in relation to and in comparison with maximizing water immersion of the contents, such as laundry or other items, for washing or rinsing. In this regard for example, the cover 43 can be a removable component selectively attached to the inner drum 40 by various means such as a plurality of latching mechanisms or threaded connections. The inner drum 40 can also be provided without a cover, but such a construction will not insure the to be washed contents inside the inner drum 40 will remain therein during the washing cycle, which can be an undesirable outcome to the user.

In order to enhance washing performance, the inner drum 40 can include a plurality of elongate, washing or agitator ridges or fins 48 disposed at angularly spaced intervals located around the interior surface of the inner drum 40, such as disposed at angularly spaced intervals, for example. These agitator fins 48 protrude a given distance towards the axis of the inner drum 40, and the agitator fins 48 form abutments that can assist in moving the laundry, contents or items in the inner drum 40 around relatively more aggressively during rotation of the inner drum 40. Such increased content movement can thereby facilitate increased thoroughness of cleaning, washing or rinsing of contents, such as laundry or other items, for example.

The inner drum 40 is rotatably mounted inside the outer drum 32 by a drive shaft 41 extending axially from the closed end of the inner drum 40. The drive shaft 41 is operably connected or communicatively connected to the driven sprocket gear 26 of the drive mechanism 20 to be selectively rotated by the driven sprocket gear 26 to selectively provide the motive force to drive the rotation of the inner drum 40. Desirably, the rotation connection includes washers 50 of a suitable material, such as a silicon material, mounted on the drive shaft 41. One of the washers 50 is disposed on the draft shaft 41 on the outer side of the closed end or bottom of the inner drum 40 to assist in providing a watertight or substantially watertight seal without interfering with the rotational movement of the inner drum 40. Another of the washers 50 is disposed on the draft shaft 41 adjacent to the outer side of the closed end or bottom of the outer drum 32 to also assist in providing a watertight or substantially watertight seal without interfering with the rotational movement of the inner drum 40. Additionally, at least one thrust bearing 52 can be mounted or positioned on the drive shaft 41 adjacent the inner side of the closed end or bottom of the outer drum 32 so as to be positioned between the washers 50 to assist in providing a relatively smooth rotation for the drive shaft 41. The inner drum 40 can also be provided with a suitable reinforcing structure, such as a spoke-like structure, integrally formed onto the bottom of the inner drum 40 or a separate component, for example, such as to assist in reinforcing the inner drum 40 during rotation thereof.

Figure 2:
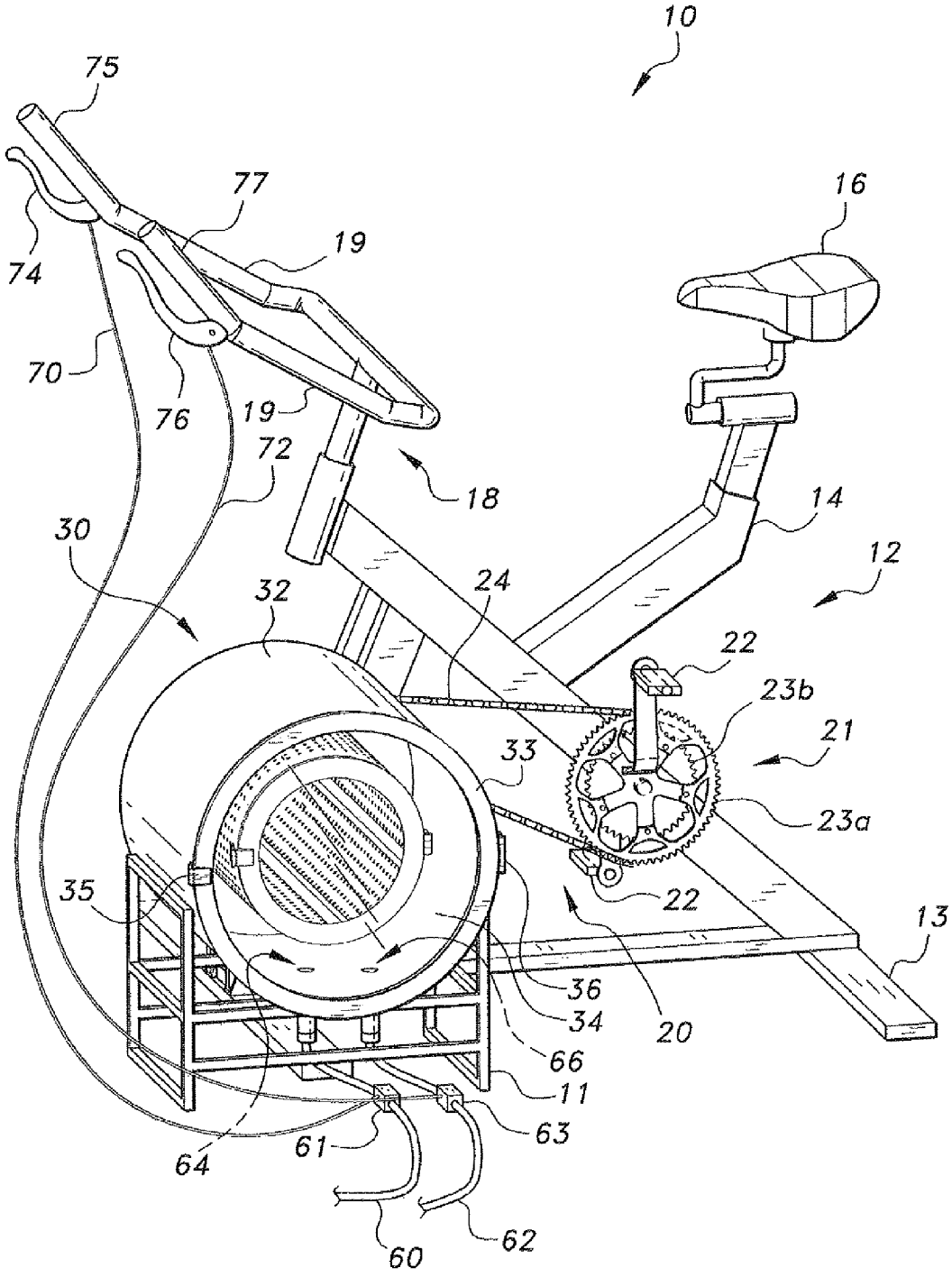
FIG. 2 is a perspective view of the bicycle-driven clothes washing machine shown in FIG. 1.
Figure 4:
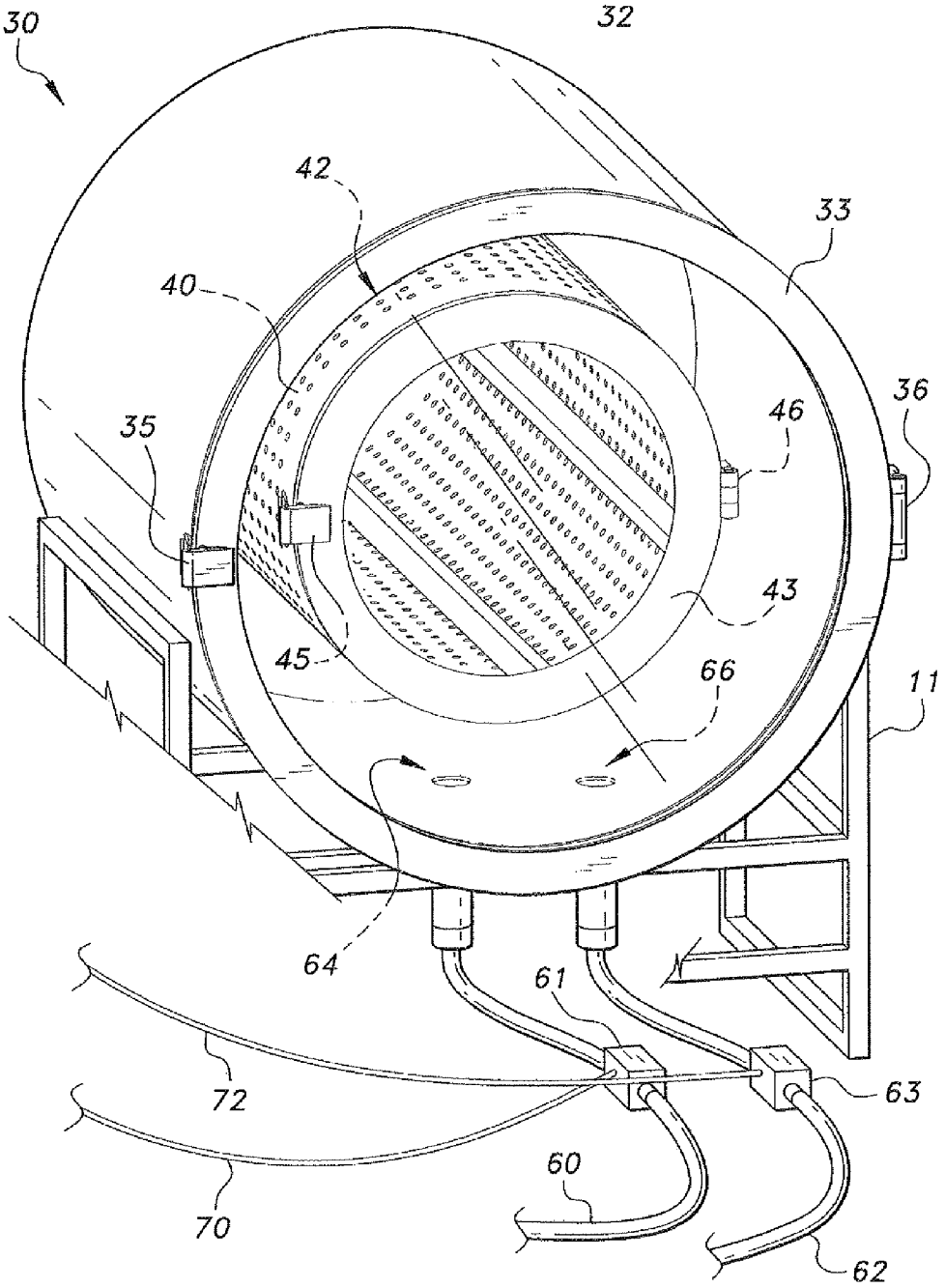
FIG. 4 is an enlarged perspective view of the washing machine drum assembly and the inlet and outlet lines connected thereto as shown in FIG. 1.

Referring to FIG. 2 and FIG. 4, an inlet line 60 and an outlet line 62 are connected to the outer drum 32. The inlet line 60 selectively introduces the washing liquid, such as including water, for washing or rinsing through an inlet opening 64 in the inner drum 32, and the outlet line 62 selectively drains the spent washing liquid, such as including spent water, through an outlet opening 66 in the outer drum 32. The inlet line 60 includes an inlet valve system 61 to permit a user of the bicycle-driven clothes washing machine 10 to selectively control an operation of introducing the washing liquid, such as including water, to the outer drum 32 for a washing operation. The outlet line 62 includes an outlet valve system 63 to permit a user of the bicycle-driven clothes washing machine 10 to selectively control an operation of draining the spent washing liquid, such as including spent water, from the outer drum 32, such as after completion of a washing operation, such as after washing, rinsing or spin drying the contents, such as laundry or other items, for example.

The inlet valve system 61 and the outlet valve system 63 can be provided in various suitable configurations. For example, the inlet valve system 61 and the outlet valve system 63 can be a simple manual valve with a handle operable by the user for opening and closing the valve, which can requires the user to dismount the exercise bike or bicycle 12 periodically for the washing and draining operations of the washing cycle. However, it is desirable that inlet valve system 61 and the outlet valve system 63 each include a biased valve type system connected to respective control lines 70, 72, for example. When such a biased valve type system is used, it is further desirable that the selective opening and closing of the inlet valve system 61 and the outlet valve system 63 be controlled by movement of control members, such as paddles 74 and 76. The paddle 74 is connected to a control line 70 communicating with the inlet valve system 61 to selectively control the opening and closing of a valve arrangement of the inlet valve system 61, the paddle 74 being mounted on a handle 75 of the handlebar 19 of the handlebar assembly 18, for example. The paddle 76 is connected to a control line 72 communicating with the outlet valve system 63 to selectively control the opening and closing of a valve arrangement of the outlet valve system 63, the paddle 76 being mounted on a handle 77 of the handlebar 19 of the handlebar assembly 18, for example. Thus, manual operation by a user of a respective paddle 74 or 76 selectively opens or closes the corresponding inlet valve system 61 or outlet valve system 63.

A typical operation and use of embodiments of a bicycle-driven clothes washing machine is described with reference to the bicycle-driven clothes washing machine 10, for example. In preparation for washing laundry or other items, the user loads the inner drum 40 with contents, such as laundry or other items, the contents can include one or more pieces of laundry or other items, to be washed and adds a desired amount of detergent or other cleaning agents. When the laundry or other items have been placed in the inner drum 40 and the detergent or other cleaning agents have been added, the user closes the cover 43 of the inner drum 40 and secures the same with the latch mechanism 45. The user then closes the cover 33 for the outer drum 32 and secures to cover 33 with the latch mechanism 35. The user mounts the exercise bike or bicycle 12 and squeezes the paddle 74 to open the inlet valve system 61 and selectively introduces the washing liquid, such as including water, into the outer drum 32. When filled to the desired level, the user releases the paddle 74 to selectively close the inlet valve system 61.

Then the user moves the drive assembly 20, such as by engaging the pedals 22, to rotate the inner drum 40, as well as can beneficially providing the user with exercise. Rotation of the inner drum 40 causes the washing liquid, such as water including one or more of the added detergent or other cleaning agents, to move about in the washing machine drum assembly 30, such as the washing liquid moving in and out through the perforations 42 and moving through the inner drum 40 and contacting the contents, such as laundry or other items, to clean the same. If the inner drum 42 includes one or more agitator fins 48, the cleaning efficiency can be increased thereby, as discussed.

The pedaling of the pedals 22 by the user of the bicycle-driven clothes washing machine 10 to drive the rotation of the inner drum 40 in a clothes washing operation can substantially reduce energy consumption for washing laundry or other items as compared to the energy consumed by a conventional washing machine, for example. Moreover, the pedaling of the pedals 22 can also provide exercise benefits to the user of the bicycle-driven clothes washing machine 10. To enhance the exercise benefits, as well as possibly adjust the speed of rotation of the inner drum 40, the user can vary the resistance through changing the gearing in the drive mechanism 20. Also, various resistance devices, such as adjustable tensioning mechanisms, can be employed to apply pressure against the drive belt or drive chain 24, such as to increase the pedaling force by a user applied to the pedals 22 to rotate the inner drum 40, for added exercise benefits to the user of the bicycle-driven clothes washing machine 10.

When the washing cycle for the bicycle-driven clothes washing machine 10 has finished, the user squeezes the paddle 76 to selectively open the outlet valve system 63 to drain the spent washing liquid from the washing machine drum assembly 30. Pedaling of the pedals 22 by the user and with the outlet valve system 63 open for draining allows the spent washing liquid to drain from the washing machine drum assembly 30, such as by the force of gravity and a centrifugal force caused by rotation of the inner drum 40, to drain the used washing liquid, such as including water, from the contents, such as laundry or other items, and out the outlet opening 66 in the outer drum 32.

Releasing the paddle 76 to selectively close the outlet valve system 63 to keep the washing liquid from exiting from the washing machine drum assembly 30, the user again squeezes the paddle 74 to selectively open the inlet valve system 61 to introduce a washing liquid, such as including water, into outer drum 32, such as for a rinse cycle. After introduction of the rinse liquid, such as including water, into the washing machine drum assembly 30, pedaling of the pedals 22 by the user rotates the inner drum 40 to rinse the contents, such as laundry or other items, such as to clean out residual detergents and other cleaning agents, and the draining process is repeated by the user squeezing the paddle 76 to selectively open the outlet valve system 63 to drain the spent rinse liquid, such as used rinse water, from the washing machine drum assembly 30 out the outlet opening 66 in the outer drum 32.

After draining the used washing liquid from the washing machine drum assembly 30, such as after rinsing the contents, such as laundry or other items, continued pedaling of the pedals 22 for a suitable period of time can further remove the washing liquid from the contents, such as laundry or other items, rinsed, such as by spin drying the contents, for example. The washing liquid, such as water or other rinsing liquid, removed from the contents, such as laundry or other items, during the spin drying, can be drained from the outer drum 32, as discussed.

Thus, a load of laundry or other items in a washing operation can be cleaned, washed, rinsed, or spin dried, such as to further remove a washing liquid, such as including water, from the contents, such as laundry or other items, in the bicycle-driven washing machine 10 with relatively no significant energy costs or relatively no significant energy use, other than a physical effort by the user in generating the motive force, such as by pedaling the pedals 22, and in selectively squeezing the paddles 74 or 76, for example. Also, a user through such physical effort can benefit from performing an exercise activity at the same time as a washing operation. While a pair of pedals 22 are illustrated, a single pedal 22 or other suitable arrangement can be provided to generate the motive force to selectively supply the motive force to selectively drive the washing machine drum assembly 30, such as to rotate the inner drum 40, for example.

Figure 6:
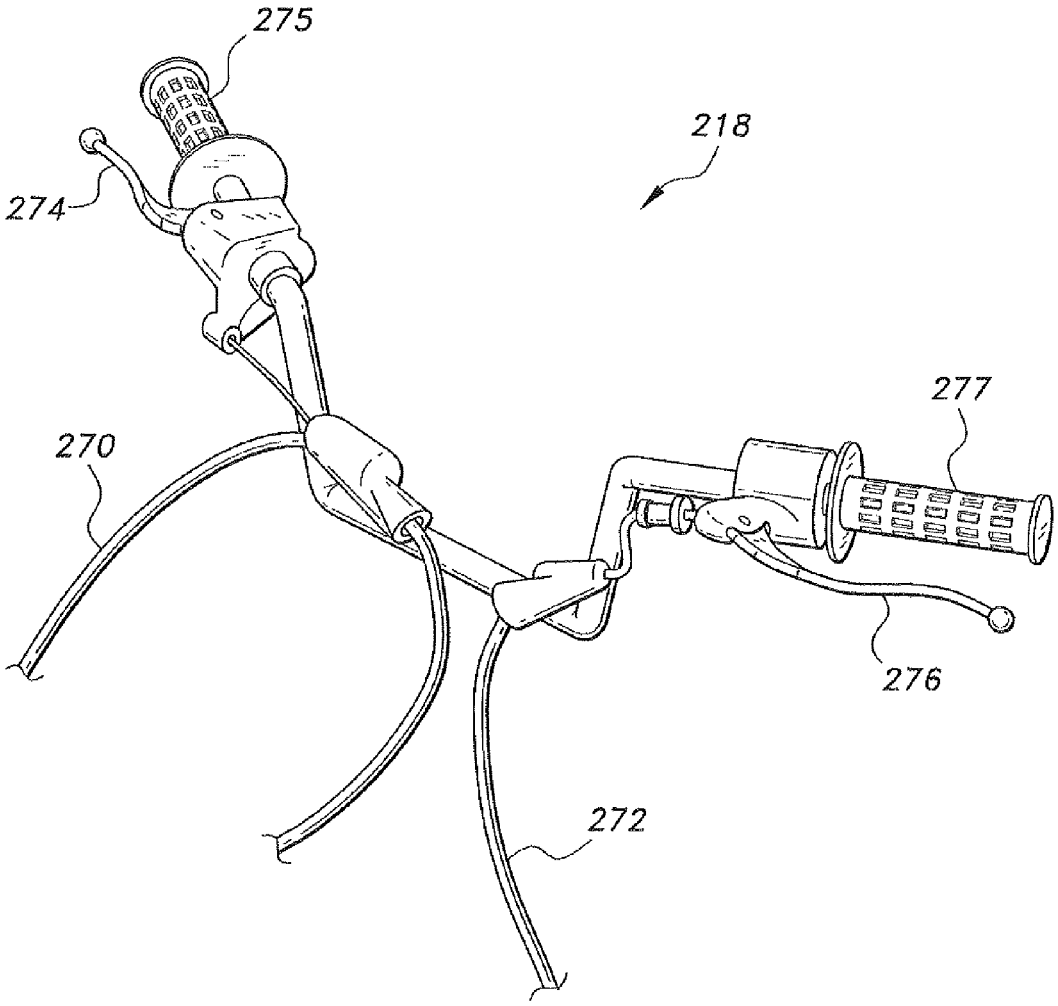
FIG. 6 is an enlarged perspective view of an embodiment of a handlebar system for a bicycle-driven clothes washing machine according to the present invention.

Other embodiments of a bicycle-driven clothes washing machine are shown in FIGS. 5 and 6, for example. In FIG. 5, an embodiment of a bicycle-driven clothes washing machine 100 includes a non-exercise bicycle 112 and, as illustrated, differs from the embodiment of the bicycle-driven clothes washing machine 10 in that the bicycle-driven clothes washing machine 100 includes the washing machine drum assembly 30 mounted or positioned adjacent to the rear of the bicycle 112, such as where the rear tire of the non-exercise bicycle 112 normally resides on a conventional bicycle. As illustrated in FIG. 5, the bicycle-driven clothes washing machine 100 can include a bicycle support base 213 to support the rear portion of the bicycle 112, such as disposed in an area where the rear tire of the non-exercise bicycle 112 normally resides on a conventional bicycle, for example. Also, a support member 113 can be detachably mounted or positioned adjacent to the rear of the non-exercise bicycle. 112 and disposed in association with a bicycle frame 114 of the non-exercise bicycle 112 to support the washing drum assembly 30, and the support member 113 can also assist in maintaining the rear section of the non-exercise bicycle 112 at an elevated position substantially in line with or in a substantially level relation to the forward section of the non-exercise bicycle 112, as at a level or position if the rear tire were mounted on the non-exercise bicycle 112.

Also, the non-exercise bicycle 112 includes the bicycle frame 114, an adjustable seat 116, and an adjustable handlebar assembly 118, the adjustable components permitting user-defined positioning of the seat 116 and handlebars 119 of the handlebar assembly 118 for comfortable physical activity. The washing, rinsing, or spin dry operations and functions of the bicycle-driven clothes washing machine 100 shown in FIG. 5 are substantially the same or similar to those discussed in relation to the bicycle-driven clothes washing machine 10, other than the location of the washing machine drum assembly 30 being positioned toward the rear of the non-exercise bicycle 112.

In this regard, the user squeezes a paddle 174 on a handle 175 on the handlebar 119 connected to a control line 170 communicating with the inlet valve system 61, similar to squeezing the paddle 74, to open the inlet valve system 61 and selectively introduces a washing liquid, such as including water, into the outer drum 32, for a washing operation, such as washing or rinsing contents, for example. When filled to the desired level, the user releases the paddle 174 to selectively close the inlet valve system 61. The pedaling of the pedals 22 by the user of the bicycle-driven clothes washing machine 100 moves the drive mechanism 20 including the drive belt or drive chain 24 to rotate the inner drum 40 in a clothes washing operation, such as a washing, rinsing or a washing or rinsing liquid draining operation, as discussed. When the washing cycle for the bicycle-driven clothes washing machine 100 has finished, the user squeezes the paddle 176 on a handle 177 on the handlebar 119 connected to a control line 172 communicating with the outlet valve system 63, similar to squeezing the paddle 76 on the handle 77, to selectively open the outlet valve system 63 to drain the spent washing or rinsing liquid from the washing machine drum assembly 30, such as after a washing operation, such as washing or rinsing contents in the washing machine drum assembly 30, for example.

In the bicycle-driven clothes washing machine 100 of FIG. 5, after draining the used washing liquid from the washing machine drum assembly 30, such as after rinsing the contents, continued pedaling of the pedals 22 for a suitable period of time can further remove a washing liquid, such as including water, from the contents, such as laundry or other items rinsed, by spin drying the contents, for example. Water removed from contents, such as laundry or other items, during the spin drying, can be drained from the outer drum 32, as discussed.

In FIG. 6, there is shown an embodiment of a mountain bike type handlebar assembly 218 illustrating various controls and control lines, such as can be associated with embodiments of a bicycle-driven clothes washing machine, such as included with the exercise bike or bicycle 12 of the bicycle-driven clothes washing machine 10 or included with the non-exercise bicycle 112 of the bicycle-driven clothes washing machine 100, for example. The handlebar assembly 218 includes a right control paddle 274 connected to an inlet control line 270 as can be connected the inlet valve system 61, a left control paddle 276 connected to an outlet control line 272 as can be connected to the outlet valve system 63, and handles 275, 277 are provided with relatively more robust dimensions and grip, for example. The operation of the right control paddle 274 in a washing operation, such as washing or rinsing contents in the washing machine drum assembly 30, is substantially the same or similar to the operation of the paddles 74 and 174, and the operation of the left control paddle 276 in a washing operation, such as a draining operation, is substantially the same or similar to the operation of the paddles 76 and 176, for example, as discussed.

It is to be understood embodiments of the bicycle-driven washing machine, such as the bicycle-driven clothes washing machine 10 or the bicycle-driven washing machine 100, can encompass various arrangements, structures or components. For example, the cover 33 of the outer drum 32 or the cover 43 of the inner drum 40 can be constructed without windows. Moreover, the outer drum 32 can include one or more opaque sections, as long as such opaque sections do not substantially impair visual monitoring of the washing machine drum assembly 30 that includes the contents, such as laundry or other items, being washed or rinsed, for example. Furthermore, the drive sprocket assembly 21 can be constructed similar to the arrangement of the plurality of drive sprocket gears 26, such as illustrated in FIG. 5, as can increase the range of variable speeds, such as corresponding to the speed of rotation of the inner drum 40, for example. Along the same lines, variable speeds, such as to control the speed of rotation of the inner drum 40, can be controlled manually or automatically, for example.

It is to be understood that the present invention is not limited to the embodiments described above, but encompasses any and all embodiments within the scope of the following claims.

I claim:

1. A bicycle-driven clothes washing machine, comprising:

a bicycle frame;

a support member disposed in association with the bicycle frame;

a washing machine drum assembly supported by the support member, the washing machine drum assembly having an outer drum at least a portion of which is transparent to visually monitor a washing operation in the washing machine drum assembly, the outer drum being selectively filled a washing liquid, the outer drum having an inlet opening and an outlet opening, and the washing machine drum assembly including an inner drum rotatably mounted inside the outer drum, the inner drum to hold contents for the washing operation, the inner drum having a plurality of perforations for ingress and egress of the washing liquid and a drive shaft extending axially from one end;

wherein the inner drum is constructed from a metal material, and the outer drum is constructed from a transparent plastic material;

a drive mechanism to provide a motive force to selectively rotate the inner drum, the drive mechanism being operable by a physical effort of a user to provide the motive force, the drive mechanism being associated with the bicycle frame and having an output mechanism communicatively connected to the drive shaft to selectively supply the motive force to selectively rotate the inner drum;

an inlet line operably attached to the inlet opening to supply the washing liquid to the outer drum; and an outlet line operably attached to the outlet opening to drain the washing liquid from the outer drum;

wherein the outer drum is constructed from a transparent plastic material.

2. The bicycle-driven clothes washing machine according to claim 1, further comprising a cover for selectively covering an open end of said outer drum, an O-ring communicating with the cover to seal the open end when the cover is closed, and at least one latching mechanism for securing said cover onto the outer drum.

3. The bicycle-driven clothes washing machine according to claim 2, further comprising a hinge mounted to said cover and said outer drum to pivotally attach said cover to said outer drum.

4. The bicycle-driven clothes washing machine according to claim 2, further comprising a window disposed on said cover, the window facilitating visual access to the washing operation inside said outer drum.

5. The bicycle-driven clothes washing machine according to claim 1, further comprising a cover for selectively covering an open end of said inner drum and at least one latching mechanism for securing the cover onto said inner drum.

6. The bicycle-driven clothes washing machine according to claim 5, further comprising a hinge mounted to said cover and said inner drum to pivotally attach said cover to said inner drum.

7. The bicycle-driven clothes washing machine according to claim 5, further comprising a window disposed on said cover, the window facilitating visual access to the contents inside said inner drum.

8. The bicycle-driven clothes washing machine according to claim 5, further comprising at least one elongate agitator fin extending axially from an interior surface of said inner drum.

9. The bicycle-driven clothes washing machine according to claim 1, wherein said drive mechanism comprises at least one pedal operable by the user, a drive sprocket assembly, at least one driven sprocket gear spaced from the drive sprocket assembly and operably connected to said drive shaft, and a drive chain or a drive belt trained around the drive sprocket assembly and a corresponding said at least one driven sprocket gear, rotation of the drive sprocket assembly by the at least one pedal rotating the corresponding said driven sprocket gear through movement of the drive chain or the drive belt.

10. The bicycle-driven clothes washing machine according to claim 9, further comprising at least one washer and a thrust bearing mounted to said drive shaft adjacent to an outer surface of a closed bottom of the inner drum.

11. The bicycle-driven clothes washing machine according to claim 1, further comprising:

a handlebar system positioned in associated with the bicycle frame; and a pair of paddles movably connected to the handlebar system, the pair of paddles each associated with a control line to respectively control selectively supplying the washing liquid to the inlet line to the outer drum and to respectively control selectively draining the washing liquid through the outlet line from the outer drum.

12. A bicycle-driven clothes washing machine, comprising:

a bicycle frame;

a support member disposed in association with the bicycle frame;

a washing machine drum assembly supported by the support member, the washing machine drum assembly having an outer drum constructed from a transparent plastic material to visually monitor a washing operation in the washing machine drum assembly, the outer drum being selectively filled a washing liquid, the outer drum having an inlet opening and an outlet opening, and the washing machine drum assembly including an inner drum rotatably mounted inside the outer drum, the inner drum to hold contents for the washing operation, the inner drum having a plurality of perforations for ingress and egress of the washing liquid and a drive shaft extending axially from one end;

a drive mechanism to provide a motive force to selectively rotate the inner drum, the drive mechanism being operable by a physical effort of a user to provide the motive force, the drive mechanism being associated with the bicycle frame and having an output mechanism communicatively connected to the drive shaft to selectively supply the motive force to selectively rotate the inner drum;

an inlet valve system selectively operable to supply the washing liquid to the inlet opening of the outer drum;

an inlet line operably attached to the inlet opening, the inlet line including the inlet valve system selectively operable to supply the washing liquid to the outer drum;

an outlet valve system selectively operable to drain the washing liquid from the outlet opening of the outer drum;

an outlet line operably attached to the outlet opening, the outlet line including the outlet valve system selectively operable to drain used washing liquid from the outer drum, and wherein selective operation of the inlet valve system selectively provides the washing liquid to the washing machine drum assembly and selective operation of the outlet valve system selectively drains the washing liquid from the washing machine drum assembly.

13. The bicycle-driven clothes washing machine according to claim 12, further comprising:

a handlebar system positioned in associated with the bicycle frame;

a pair of paddles associated with said handlebar system; and a control line extending from each paddle of the pair of paddles and a corresponding said control line respectively communicating with the inlet valve system and the outlet valve system, wherein selective squeezing of a corresponding one of the paddles communicates through a corresponding said control line to open a corresponding one of the inlet valve system to introduce the washing liquid or the outlet valve system to drain the washing liquid, and selective release of the corresponding one of the paddles communicates through the corresponding control line to close the corresponding one of the inlet valve system or the outlet valve system.

14. The bicycle-driven clothes washing machine according to claim 12, wherein the bicycle frame includes an adjustable handlebar system and an adjustable seat, and the drive mechanism includes a pair of pedals manually operable by a user to provide the motive force to selectively rotate the inner drum.

15. A bicycle-driven clothes washing machine, comprising:

a bicycle frame including a handlebar system, a first control paddle, and a second control paddle, each of the first and second control paddle being movably connected to the handlebar system;

a drive mechanism consisting of:

at least one pedal;

a drive sprocket assembly coupled to the at least one pedal;

at least one driven sprocket gear spaced from the drive sprocket assembly;

a drive shaft operably connected to the at least one driven sprocket gear, and a flexible member for engaging the drive sprocket assembly and the at least one driven sprocket gear;

wherein upon rotation of the at least one pedal, the drive sprocket assembly simultaneously being rotated, the flexible member thereby moving in concert with the drive sprocket assembly, the moving of the flexible member correspondingly causing the at least one driven sprocket gear to rotate, and the rotation of the at least one driven sprocket gear simultaneously rotating the drive shaft;

a support member coupled to the bicycle frame;

a washing machine assembly supported by the support member;

the washing machine assembly consisting of:

an inner drum, the inner drum formed of a perforated metallic material, and including a windowed door hingedly attached thereto, and a latch for selectively securing the windowed door thereto;

the inner drum is operatively connected to the drive shaft;

at least one agitation fin coupled to the interior of the inner drum;

an outer drum, the outer drum formed of substantially transparent plastic material, and including a substantially transparent door hingedly attached thereto, an O-ring coupled to the substantially transparent door for sealing the substantially transparent door to the outer drum in a closed position, and a latch for selectively securing the substantially transparent door in the closed position, the outer drum being coaxially disposed about the inner drum;

wherein the inner drum is rotatably mounted within the outer drum;

a fluid inlet line coupled to the outer drum, the inlet line having an inlet valve for selectively allowing fluid to enter the outer drum;

a fluid outlet line coupled to the outer drum, the outlet line having an outlet valve for selectively allowing fluid to exit the outer drum;

a first control line coupled between the first paddle and the inlet valve; and a second control line coupled between the second paddle and the outlet valve;

wherein each one of the first and second paddles respectively and selectively control the supplying fluid through the fluid inlet and outlet lines, into and out of the outer drum;

whereby clothes are washed within the inner drum, when fluid passes through the plurality of perforations, and when agitated by the agitator fin upon rotation of the inner drum, and bicycle frame provides exercise when the at least one pedal is manipulated.

* * * * *